US005154535A

United States Patent [19]

Bays

[11] Patent Number: 5,154,535

[45] Date of Patent: Oct. 13, 1992

[54] ROAD BREAKING EQUIPMENT

[76] Inventor: Marvin G. Bays, 2104 Melrose, Ponca City, Okla. 74601

[21] Appl. No.: 646,282

[22] Filed: Jan. 28, 1991

[51] Int. Cl.[5] ..... E01C 23/08; E21C 47/00

[52] U.S. Cl. ..... 404/90; 299/37

[58] Field of Search ..... 404/91, 137, 133; 299/37; 173/94, 133

[56] References Cited

U.S. PATENT DOCUMENTS

| | | | |
|---|---|---|---|
| 2,529,892 | 11/1950 | Adams | 299/37 |
| 3,133,730 | 5/1964 | Cornett | 404/90 X |
| 4,251,111 | 2/1981 | Gurries | 299/37 |
| 4,340,255 | 7/1982 | Gurries | 299/37 |
| 4,457,645 | 7/1984 | Klochko | 404/90 |
| 4,511,282 | 4/1984 | Gurries | 404/90 |
| 4,515,408 | 5/1985 | Gurries | 404/90 X |
| 4,732,506 | 3/1988 | Bays | 404/133 X |
| 4,906,049 | 3/1990 | Anderso | 173/133 |
| 4,997,050 | 3/1991 | Allan | 299/37 X |

*Primary Examiner*—Terry Lee Melius
*Assistant Examiner*—Nancy P. Connolly

[57] ABSTRACT

An improved apparatus for breaking hard surfaces which has a torsional spring and an oscillating member attached to the spring along the spring length and to a working tool and a hydraulic generator at either end. A tubular housing anchors the torsional spring at one end to prevent reciprocal movement and is also attached by an attachment means to the torsional reaction mass. Another tubular housing is attached to the torsional reaction mass at one end and to the bearing housing at the other.

7 Claims, 3 Drawing Sheets

ROAD BREAKING EQUIPMENT

BRIEF DESCRIPTION OF THE PRIOR ART

The best prior art known to applicant is U.S. Pat. No. 4,732,506 titled Surface Crushing Apparatus, issued Mar. 22, 1989 by Marvin Bays, the same inventor as this invention which discloses an apparatus which uses an impact tool mounted on an arm which has a vibrator mounted on the other end of the arm. A torsional spring is attached central to the arm and is anchored at its opposite end to the torsional reaction mass. The vibrator is operated at resonance to magnify the total forces delivered to the impact tool. Proper isolation apparatus is attached between the torsional reaction mass and support frame to isolate the vibrations from the support frame and vehicle carrying the above. Said Patent is assigned to the same assignee as this invention.

BRIEF DESCRIPTION OF THE INVENTION

This invention is an improvement over the above described invention by having a centrally mounted torsional reaction mass structure. A cylindrical tube surrounds the torsional spring from the torsional reaction mass to the end of the torsional spring. An attachment connects the end of the torque spring to the end of the cylindrical tube. A second cylindrical tube is attached between the torsional reaction mass and the other end of the torsional spring at the bearing supporting the torsional spring. A vibration isolation mounting system consists of a plate attached to each end of the cylindrical tubes, a second pair of plates attached to the support frame and spaced from the plates attached to the cylindrical tubes. Yieldable isolation devices are attached between each of the plates and to each of the second pair of plates in a manner to couple each end of each cylindrical tube to the support frame through the yieldable isolation apparatus.

DETAILED DESCRIPTION OF THE INVENTION

Figure 1:
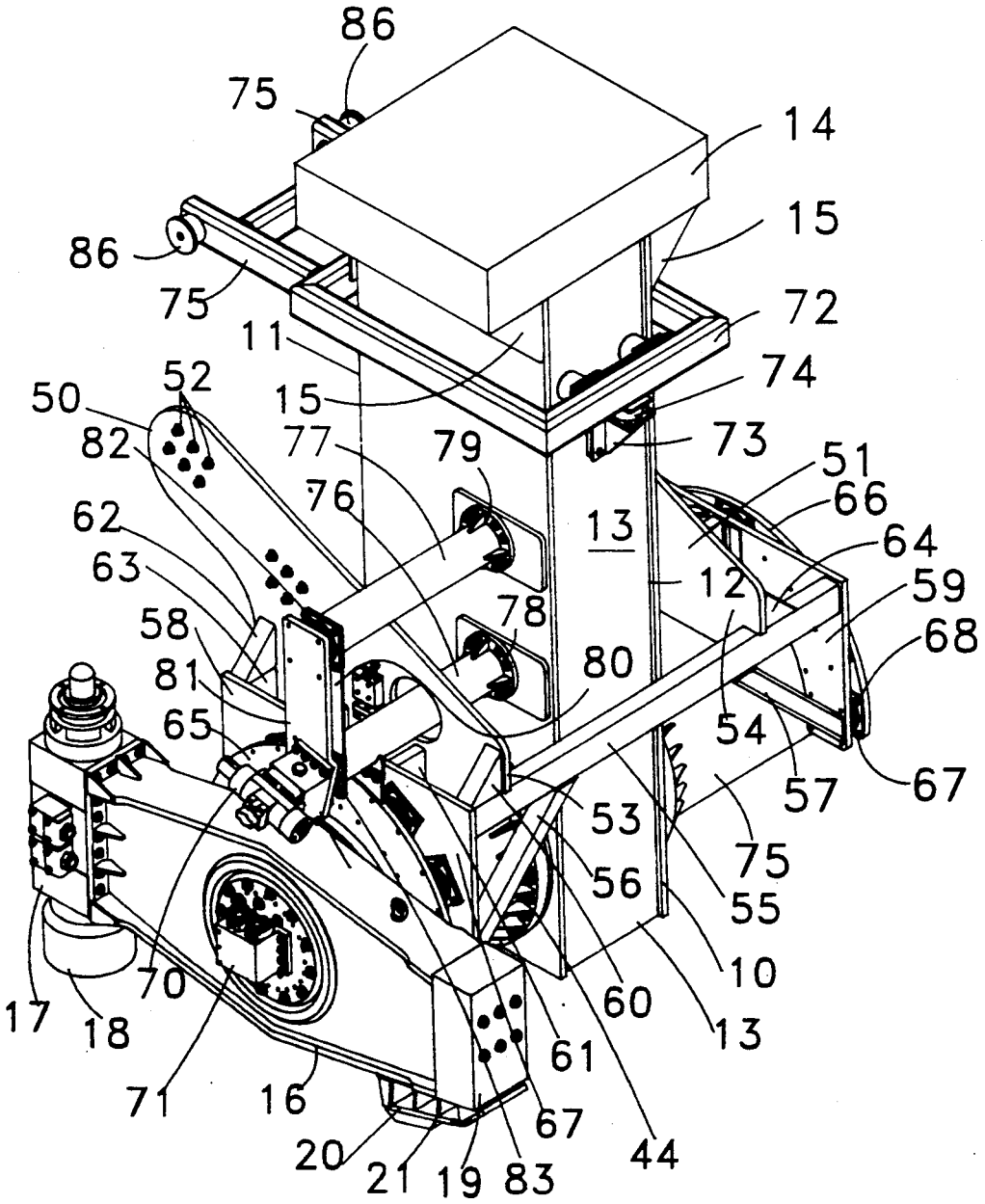
FIG. 1 is an isometric projection of the road breaking equipment without the vehicle.

Referring to all of the figures but in particular to FIG. 1, a torsional reaction mass referred to by arrow 10 is formed from a pair of side plates 11 and 12, and a pair of end plates 13 (one opposite 13 end not illustrated). A mass 14 is attached by bolting or welding to side plates 11 and 12, and end plates 13. Mass 14 is further supported by triangular metal supports 15, two of which are illustrated, attached to side plates 11 and 12 respectively.

Figure 2:
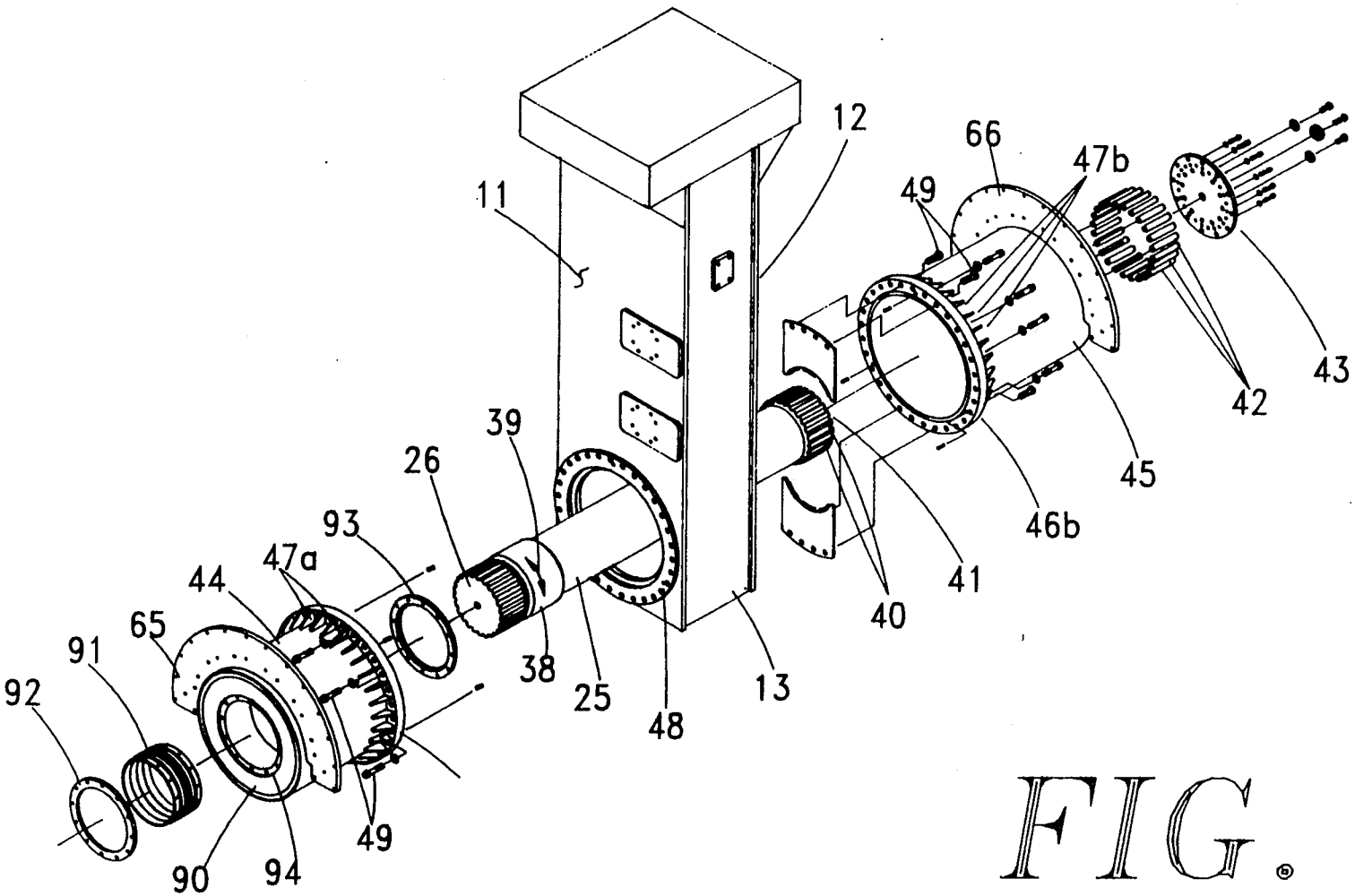
FIG. 2 is an expanded view of a portion of FIG. 1 illustrating the attachment of the torsional spring to the support frame; and, FIG. 3 is an exploded view of the oscillating member assembly shown in FIG. 1.
Figure 3:
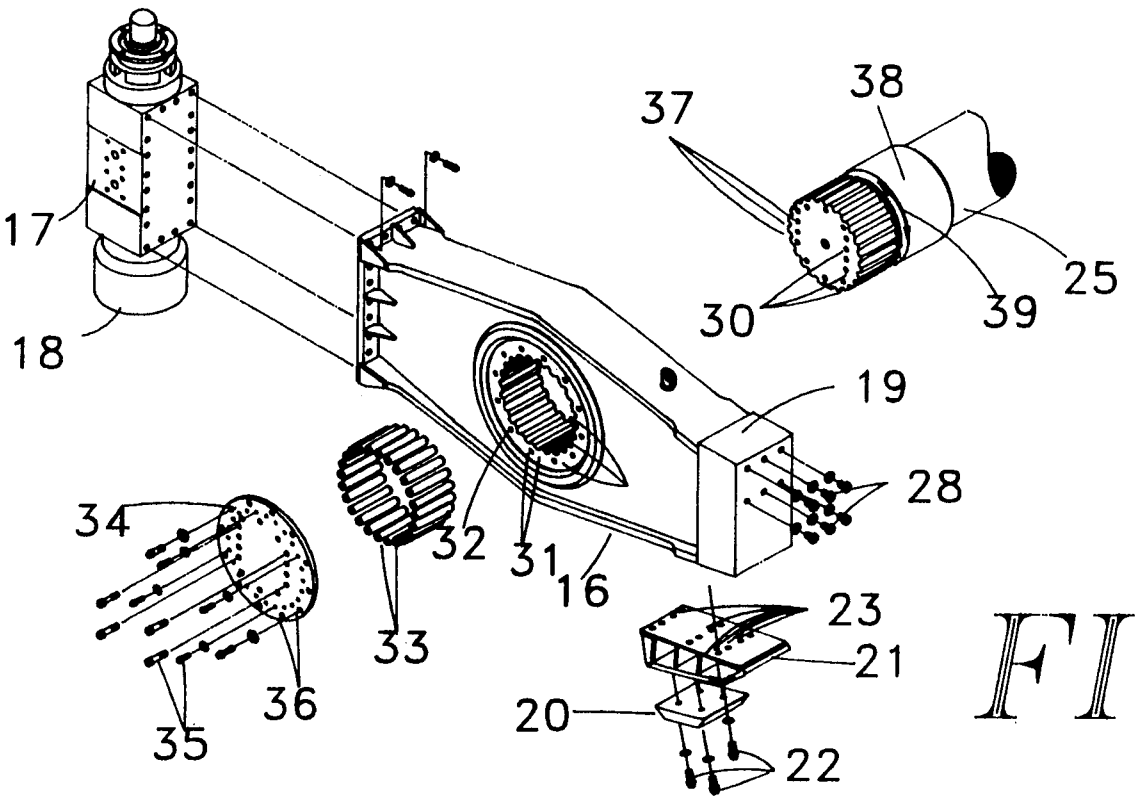

An oscillating member generally referred to by arrow 16 has a servo-hydraulic vibrator 17 attached. A vibrator reaction mass 18 is attached to an internal piston rod (not shown). At the other end of oscillating member 16 is attached an impact mass 19 and an impact tool 20. Impact tool 20 is usually attached with bolts 22 (see FIG. 3) so that the tool can be replaced as wear occurs during prolonged operations. Referring in particular to FIG. 2, a torsional or torque spring 25 is rigidly anchored at one end 26 to arm 16. Referring to FIGS. 1 and 3, the actual apparatus for making the rigid connection and the assembly of the vibrator and the impact tool is better illustrated. Tool 20 is attached to arm 16 by means of a mounting assembly 21 which is attached to arm 16 by means of a plurality of bolts (not shown) through openings 23. Impact mass 19 has a plurality of bolts 28 by which additional mass can be attached to the end of arm 16. Torsional spring 25 is rigidly attached to arm 16 by means of a plurality of peripheral groves 30 which mate with peripheral groves 31 in an opening referred to by arrow 32. Once groves 30 are mated with groves 31, then a plurality of pins 33 are inserted into each of the openings formed by groves 30 and 31. To retain pins 33 in groves 30 and 31 during the vibrations generated by the vibrator 17, mass 18, and impact tool 20, an end plate 34 is attached over the ends of the pins 33 by inserting bolts 35 through plate 34, into a plurality of openings 36 and into a plurality of threaded openings 37. A bearing, see FIG. 2, includes a bearing housing 90 which is anchored into cylindrical tube 44, and contains bearing 91 which is anchored into housing 90 by a pair of lock rings 92 and 93. Lock ring 92 is anchored into recess 94 with a similar recess on the opposite side of bearing housing 90 for lock ring 93. Bearing 91 surrounds bearing surface 38 on torsional spring 25 to permit oscillation of said spring 25 in the direction of arrow 39.

Referring again to FIGS. 2 and 3, the remaining end of torsional spring 25 is rigidly attached to a mounting (not shown) which is similar to the attachment to arm 16. The attachment includes the aforementioned mounting which has a plurality of slots identical to slots 31 in opening 32 of arm 16. A second set of slots 40 in torsional spring 25 at end 41 is formed the periphery of spring 25 and is similar to the slots 30 in spring 25. A second set of pins 42 are installed with end plate 43 in the identical manner as described with respect to pins 33 and end plate 34. The pins may be chemically anchored in the slots if desired with any of a number of locking compounds.

In order to support each end of torsional spring 25, a unique support structure is disclosed and consists of a pair of cylindrical tubes 44 and 45. At each end of each tube is an attachment flange **46*a* and 46*b* respectively. Each of the flanges is welded to the outer periphery of tubes 44 and 45 respectively. A plurality of triangular members 47*a* and 47*b* are welded between flanges 46*a* and 46*b* and tubes 44 and 45 respectively. Each flange 46*a* and 46*b* attaches to the side plates 11 and 12 respectively by means of a reinforcing flange 48, one of which is illustrated, using a plurality of bolts 49 ,for example. The outer ends of cylindrical tubes 44 and 45 each has a pair of arcuate plates 65 and 66 welded normal to its periphery. These arcuate plates cooperate with the vehicle isolation and hold-down equipment and its associated mounting and retaining apparatus along with the torsion reaction mass referred to by arrow 10**, while isolating the vehicle and its support equipment from the forces generated by the impact hammer.

With particular reference to FIG. 1 the vehicle attachment and coupling assembly is illustrated. The vehicle is not shown, but can be a Caterpillar type front-end loader which is well known in the industry. The vehicle will contain the necessary hydraulic equipment for operating both the vehicle and the road breaking equipment which is the subject of this patent. In order to attach the road breaking equipment to the front-end loader, arms 50 and 51 are attached to the front-end loader by means of bolts 52. Each arm is connected to maintain its position by welding ends 53 and 54 intermediate the ends of a horizontal bar 55. A pair of end plates 58 and 59 are attached to each end of horizontal bar 55 and stiffeners 56 and 57 respectively. Additional stiffeners are incorporated as needed to give rigidity to plates 58 and 59, for example, members 60, 61, 62, 63 and 64.

Arcuate plates 65 and 66 are attached to the end of cylindrical tubes 44 and 45 respectively as previously described. A plurality of isolation pads referred to by arrow 67 is bolted between each arcuate plate 65 and 66, and plate 58 and 59 respectively. Each pad 67 comprises a pair of plates 68 bolted to each of the arcuate plates 65 and 66 and to each of the end plates 58 and 59 respectively. A yieldable material such as rubber is attached between the plates 68 to furnish a resilient support between the vehicle holding the road breaking equipment and the road breaking equipment itself. The isolation members provide adequate mechanical coupling without transmitting excessive vibrational coupling to the support vehicle.

The hydraulic control equipment for the road breaking equipment is standard and will not be described in detail. Basically, a source of hydraulic power such as a pump and a reservoir is mounted on the vehicle. Hydraulic hoses convey the fluid from and to a control valve 70. Hydraulic fluid is then directed to an axially mounted block 71. The hydraulic fluid is then directed to the hydraulic vibrator 17 for control of the internal piston which is coupled to mass 18. Movement of mass 18 causes arm 16 to oscillate as indicated by arrow 39 (see FIG. 3). If impact tool 20 is in contact with a solid surface such as concrete pavement, then the kinetic energy generated by vibrator 17 will be transmitted into the pavement causing the pavement to be broken.

The upper end of torsional reaction mass 10 is slidably supported by a rectangular frame member 72 which is isolated from the vehicle by a triangular support 73 which is bolted to torsional reaction mass 10. An isolation pad 74 is attached to triangular support 73 and bears the weight of frame 72. Extensions 75 are coupled through bearings 86 for attachment to the lifting portion of the vehicle.

Tubular supports 76 and 77 are anchored through flanges 78 and 79 to torsional reaction mass 10. A plate 80 supports plate 81 through isolation pads 82 and 83. Control valve 70 is supported by plate 81 and manifold 84.

OPERATION

The road breaking equipment operates much in the same manner as the equipment described in the aforementioned patent to Marvin Bays. A vehicle is attached to arms 50 and 51, and bearings 86. The vehicle is a front loader type vehicle therefore has its own hydraulic lifting apparatus. The entire frame can be lifted or lowered by the vehicle equipment as desired. When a surface is to be broken the vehicle is positioned at the location to be broken and the lifting equipment lowered to place a predetermined weight on the surface to be broken. The control apparatus for predetermining the proper weight is also fully described in the aforementioned patent. Once the proper weight is placed on the surface, the hydraulic vibrator 17 is operated causing impact tool 20 to impact the surface, breaking same.

In the prior patent, one of the major problems was the transmission of the impact forces to the frame supporting the impact tool. These extreme forces tended to crack or fracture the frame and weld joints, requiring a substantial amount of down time for repair of the unit. This invention distributes the forces in a different manner, thereby, substantially reducing the maximum forces placed on any particular location. To accomplish the above, the torsion spring was anchored using a large diameter tube attached between torsional reaction mass 10 and the anchor for the rigid end 40 of torque spring 25. Rather than forces being transmitted through a plurality of welded bars, the forces are transmitted through cylindrical tube 45 to the side of torsional reaction mass 10. Further, the forces are transmitted through a large area through flange **46*b* to torsional reaction mass 10**, further reducing the maximum force to the frame.

The bearing end 38 of torsional spring 25 likewise has a substantial reduction in maximum force to the frame using a second cylindrical tube 44. Its flange **46*a* likewise distributes the maximum force through a wide area to torsional reaction mass 10. As a result of the above, the forces from the restrained end of spring 25 and the bearing end of spring 25 are distributed uniformly over torsional reaction mass 10**, thereby substantially reducing the maximum forces on any one location.

CONCLUSION

A unique construction of the support for a torque spring used in the breaking of hard surfaces is described. A pair of cylindrical tubes are constructed for both anchoring the fixed end of the spring and for supporting the bearing end of the spring. Flanges attach both cylindrical tubes to the torsional reaction mass thereby distributing the generated forces uniformly to the torsional reaction mass substantially reducing the damaging forces to the torsional reaction mass. As a consequence of the above, the equipment has a much reduced down time with virtually no breakage to the frame and associated structure due to excessive forces being applied thereto.

What is claimed is:

1. An improved apparatus for breaking a hard surface having an hydraulic force generating means, a torsional spring means having first and second ends, means for rigidly anchoring said first end in a manner to prevent reciprocating movement of said first end, oscillation member means having first and second ends, means for attaching said torsional spring means between said first and second ends of said oscillation member means with said impacting tool attached at said first end and said hydraulic force generating means attached at said second end, a mounting means disposed between said first and second ends of said torsional spring means, an improvement comprising:

(a) a first tubular housing having its inner dimensions larger than the outside dimensions of said torsional spring means with one end of said tubular housing attached to said means for rigidly anchoring said first end, and means for rigidly attaching the remaining end of said tubular housing to said mounting means;

(b) bearing means rotatably supporting said torsional spring in the proximity of said oscillation member means; and, (c) a second tubular housing having its inner dimensions larger than the outside dimensions of said torsional spring, with one end of said tubular housing rigidly attached to said mounting means and the remaining end attached to said bearing means;

whereby said torsional spring means can be better supported during the generation of high forces during impact of said impacting tool.

2. An apparatus as claimed in claim 1 wherein said means for rigidly anchoring said torsional spring means comprises an end plate having its outer periphery attached to said one end of said tubular housing and its center portion attached to said first end of said torsion spring means.

3. An apparatus as claimed in claim 1 including support means for said torsional spring means and said first tubular housing, said support means including an arcuate plate mounted normal to the periphery of said first tubular housing, plate means spaced from said arcuate plate, yieldable means attached between said arcuate means and said plate means, and means attaching said plate means to said mounting means.

4. An apparatus as claimed in claim 1 including a second support means comprising a second arcuate plate attached to the periphery of said second tubular housing, a second plate means, yieldable means attached between said second plate means and said second arcuate plate, and means attaching said second plate means to said mounting means.

5. An apparatus as claimed in claim 3 wherein said yieldable means comprises a plurality of isolation means, each comprising a first plate attached to said first plate means, a second plate attached to said arcuate plate, and yieldable material attached between said first and second plates.

6. An apparatus as claimed in claim 4 wherein said yieldable means comprises a plurality of isolation means, each comprising a first plate attached to said first plate means, a second plate attached to said arcuate plate, and yieldable material attached between said first and second plates.

7. A mounting for an impacting tool for breaking a hard surface comprising:

(a) a centrally located reaction mass member including a rigid housing having at least a top and oppositely facing sides;

(b) means for attaching a reaction mass to said top of said rigid housing;

(c) means for attaching a pair of torsional tubes to each of said oppositely facing sides, said tubes extending away from said sides and each having an end;

(d) means for rigidly attaching a torsional spring through said tubes extending away form said sides, and to one of said ends, and rotatably journaled in said remaining end, said torsional spring having a portion extending past said journaled end; and, (e) means for attaching said impact tool to said portion of said torsional spring extending past said journaled end;

whereby said torsional reaction mass member is kept centrally located and sufficiently rigid to withstand the extreme forces transmitted thereto by said impact tool and said torsional spring.

* * * * *